United States Patent [19]

Horbinski

[11] Patent Number: 4,565,016

[45] Date of Patent: Jan. 21, 1986

[54] PERSPECTIVE DRAFTING INSTRUMENT

[76] Inventor: Ronald T. Horbinski, 3159 N. Humboldt Blvd., Milwaukee, Wis. 53212

[21] Appl. No.: 628,390

[22] Filed: Jul. 6, 1984

[51] Int. Cl.[4] ..... B43L 13/14

[52] U.S. Cl. ..... 33/432; 33/1 CC; 33/1 K; 33/434

[58] Field of Search ..... 33/432, 433, 434, 1 K, 33/1 CC, 174 G, 174 B

*Primary Examiner*—Willis Little

*Attorney, Agent, or Firm*—Andrus, Sceales, Starke & Sawall

[57] ABSTRACT

A drafting instrument (14) is provided for drawing perspective lines without physically preestablishing and marking a vanishing point. A carriage (16) and drawing blade (18) are supported on roller means (20) for movement along a drawing surface. Control means (24) adjustably pivots the roller means such that each point along the drawing blade scribes an arc about a common point as the carriage moves. The drawing blade defines substantially parallel lines in perspective radiating substantially from the common point as a vanishing point as the carriage moves.

12 Claims, 7 Drawing Figures

PERSPECTIVE DRAFTING INSTRUMENT

BACKGROUND AND SUMMARY

The present invention provides a drafting aid affording a simple technique for laying out perspective drawing lines which radiate from a common vanishing point, without physically pre-establishing and marking such point.

The instrument of the present invention facilitates cost effective drafting techniques by eliminating the need to physically pre-establish a vanishing point as by setting a pin or nail, and then drawing lines therefrom with a straight edge, string or the like. The invention is also particularly desirable when the distance from the desired vanishing point to the drawing surface is too great to be reached by any practical, physical means.

The invention is of particular benefit to the designer or graphic artist who does not possess the skill or knowledge necessary to do three-dimensional drawings, or cannot achieve the proper perspective because the necessary vanishing points fall outside the drawing boards' surface. The usual solution when faced with off-the-surface vanishing points is to "jury-rig" physical points by means of pins, nails or the like on a long board on one or both sides of the drawing surface. The distance of these points from the drawing surface is set to provide a realistic rendering. These techniques are cumbersome and extremely time consuming and labor intensive.

The present invention also aids the experienced designer who has learned to "eye-ball" perspective drawings and does not rely on the traditional methods to physically pre-establish or determine placement of vanishing points, station points, horizon lines, measuring lines, etc. Even the experienced artist may encounter problems, however, when it is necessary to draw numerous parallel lines in perspective, especially when those lines will also be used as measurement guides for objects which appear close and distant simulataneously, or for rendering horizontal textures.

The present invention simply and efficiently enables the drawing of numerous parallel lines in perspective from vanishing points of the operator's choosing. The device provides both right and left vanishing points as desired, including selective adjustment of the desired vanishing point distance and radius of the arc scribed. The drawing may be removed and completed or modified at a later date on a different surface and/or the identical vanishing points may be re-established by the same settings. There are no special set-ups or calculations necessary.

DESCRIPTION OF THE INVENTION

Figure 1:
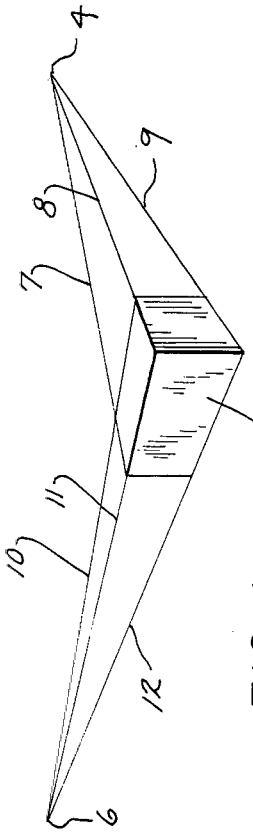
FIG. 1 is a schematic illustration of drawing perspective lines from a vanishing point.

FIG. 1 shows a box 2 drawn in perspective from right and left vanishing points 4 and 6. Perspective drawing lines 7–9 are drawn from common right vanishing point 4 and form designated sides of box 2. Lines 7–9 radiate from common point 4 as a vanishing point and are substantially parallel in perspective. Perspective drawing lines 10–12 are drawn from common left vanishing point 6 and form other designated sides of box 2. Lines 10–12 radiate from common point 6 as a vanishing point and are substantially parallel in perspective. In the prior art, vanishing points 4 and 6 are typically physically pre-established and marked by a peg, pin or the like, and lines 7–9 and 10–12 are drawn by a string, straight edge or the like therefrom.

Figure 2:
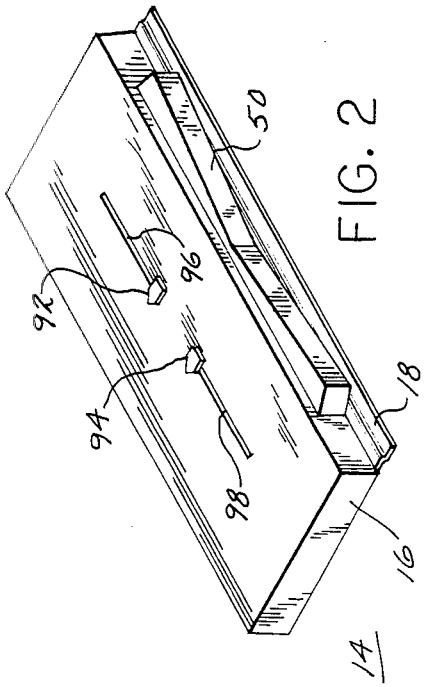
FIG. 2 is an isometric view of a drafting instrument constructed in accordance with the invention.
Figure 3:
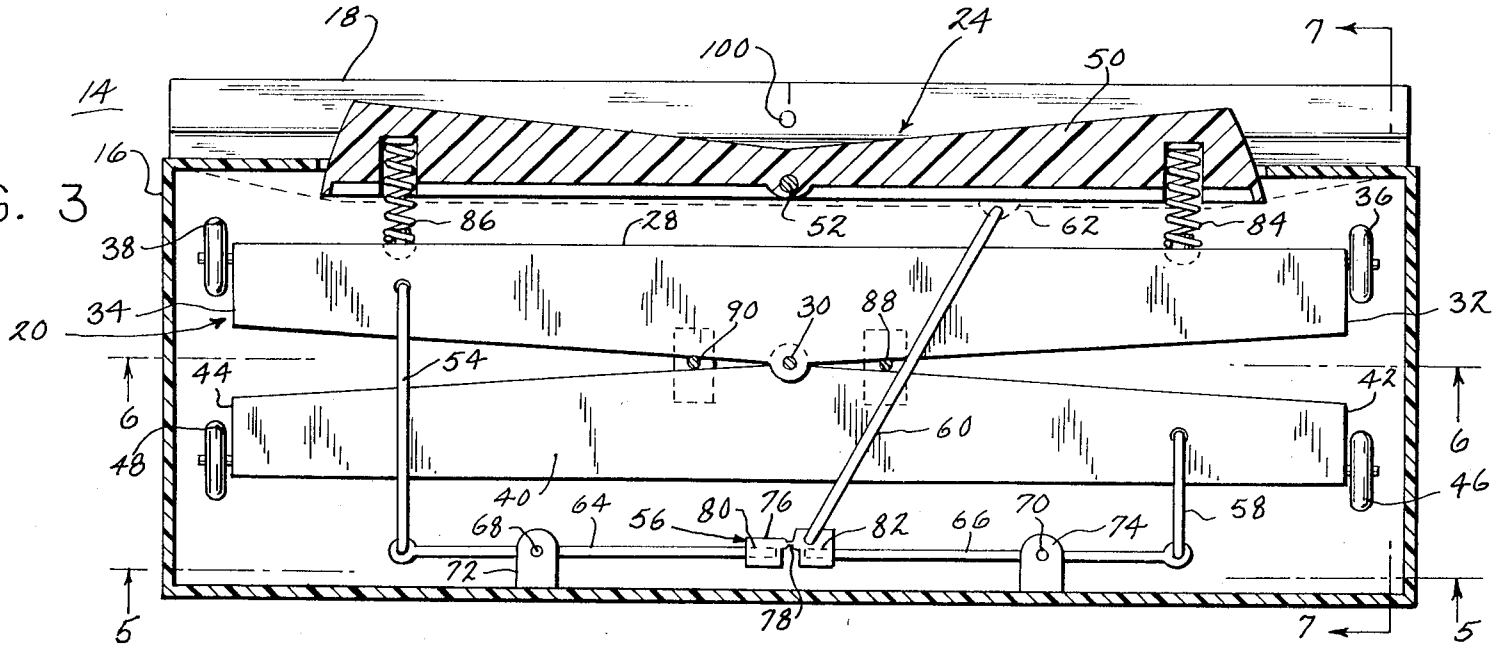
FIG. 3 is a top sectional view of the device in FIG. 2.
Figures 4, 5, 6, 7:
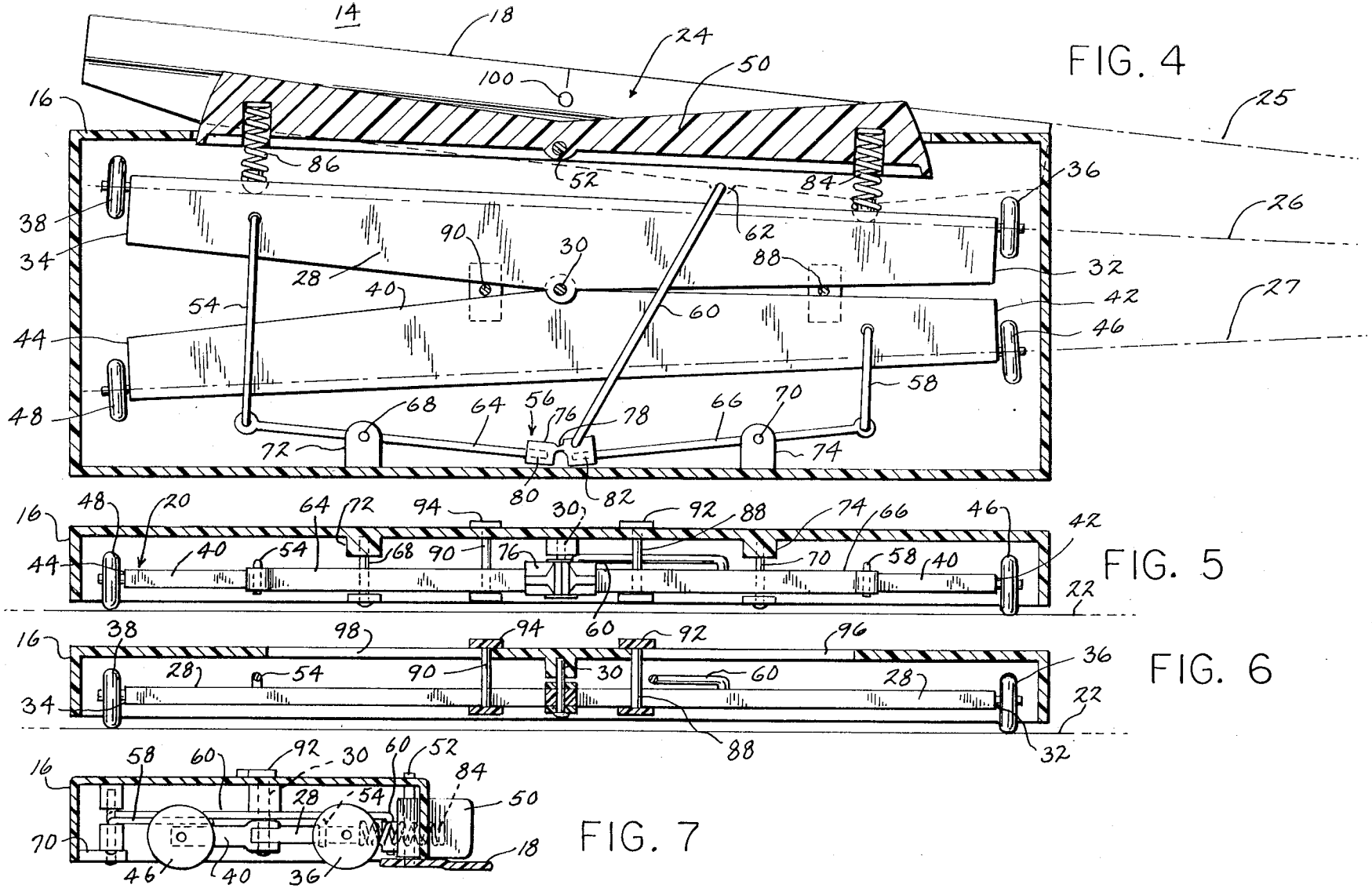
FIG. 4 is a view like FIG. 3 showing an actuated operational mode.
FIG. 5 is a cross sectional view taken along line 5—5 of FIG. 3.
FIG. 6 is a cross sectional view taken along line 6—6 of FIG. 3.
FIG. 7 is a cross-sectional view taken along line 7—7 of FIG. 3.

FIGS. 2–4 show a drafting instrument 14 constructed in accordance with the invention for drawing perspective lines without physically pre-establishing and marking a vanishing point. The device includes a carriage 16 and a drawing blade 18 on the carriage providing an edge for drawing the perspective lines. Roller means 20 supports the carriage for movement along a drawing surface 22, FIGS. 5–7. Control means 24 is provided for adjustably pivoting the roller means such that each point along drawing blade 18, FIG. 4 scribes an arc about a common point as the carriage moves. Drawing blade 18 defines substantially parallel lines in perspective such as 25–27 radiating substantially from the common point as a vanishing point as the carriage moves. The common vanishing point in FIG. 4 is off the paper at the intersection of lines 25–27.

Roller means 20 comprises axle means pivotably mounted to carriage 16 and having wheel means rotatably secured thereto. The axle means includes a first axle 28 pivotally mounted at pin 30 to the carriage between the distal ends 32 and 34 of the axle and having wheels 36 and 38 rotatably mounted at the distal ends. The axle means includes a second axle 40 pivotally mounted at pin 30 to the carriage between the distal ends 42 and 44 of axle 40 and having wheels 46 and 48 rotatably mounted at the the distal ends.

Axles 28 and 40 have the same pivot point at 30. Control means 24 comprises means for adjustably setting the degree of pivoting of the axle means, FIG. 4, to selectively set the radius of the noted arc and the distance of the vanishing point. The control means includes a shallow V-shaped actuator bar 50 pivotally mounted to the carriage at pin 52 and having a first clockwise pivoted condition, FIG. 4, oppositely pivoting the first and second axles 28 and 40 at their right ends 32 and 42 towards each other. Actuator bar 50 has a counterclockwise pivoted second condition oppositely pivoting axles 28 and 40 at their left ends 34 and 44 towards each other. Drawing blade 18 is pivotally mounted to the carriage at pin 52 and thus has the same pivot point as actuator bar 50.

First axle 28 is connected by a first link 54 to transition means 56 which is connected by a second link 58 to second axle 40 for effecting movement of axle 40 oppositely to axle 28. Transition means 56 is also connected by a third link 60 to drawing blade 18 at boss 62 for pivoting the drawing blade in response to pivotal movement of actuator bar 50.

Transition means 56 includes first and second spaced connecting rods 64 and 66 each pivotally mounted between its distal ends to the carriage at respective pins 68 and 70 on respective bosses 72 and 74. Rod 64 is connected on the left side of its pivot 68 to first link 54, and on the right side of its pivot to hinge means 76 providing the noted transition means. Hinge 76 is a living hinge preferably formed of nylon or the like having a flexible reduced thickness hinge joint 78. Second rod 66 is connected on the left side of its pivot 70 to hinge 76 and on the right side of its pivot to second link 58. Hinge 76 may have reception sleeves such as shown in dashed line at 80 and 82 for freely receiving the ends of rods 64 and 66, depending on the degree of movement.

Actuator bar 50 is pivoted to its first actuated clockwise condition by depressing the right side thereof, FIG. 4, which acts through spring 84 to pivot axle 28 clockwise about point 30 which causes first link 54 to move upwardly to pivot rod 64 clockwise about point 68 which moves hinge 76 downwardly and acts through hinge 74 to cause rod 66 to pivot counterclockwise about point 70 which causes second link 58 to move upwardly to pivot axle 40 counterclockwise. Downward movement of hinge 76 also moves third link 60 downwardly to pivot drawing blade 18 clockwise about point 52.

Actuator bar 50 is pivoted about point 52 to its counterclockwise actuated second condition by depressing the left side thereof which acts through spring 86 to pivot axle 28 counterclockwise about point 30 which causes first link 54 to move downwardly to pivot rod 64 counterclockwise about point 30 which moves hinge 76 upwardly and acts through hinge 76 to cause rod 66 to pivot clockwise which moves second link 58 downwardly which causes axle 40 to pivot clockwise. Upward movement of hinge 76 also moves third link 60 upwardly to pivot drawing blade 18 counterclockwise about point 52.

Left and right adjustably movable stops 88 and 90 are provided on the carriage. These stops are pins extending from indicators 92 and 94 slideable left-right in slots 96 and 98 in the top cover. Right stop 88 stops clockwise pivoting of axle 28 and counterclockwise pivoting of axle 40 to selectively set the arc radius of rolling movement of wheels 36, 46, 38 and 48 along drawing surface 22 such that each point along drawing blade 18 scribes an arc about a common right vanishing point as the carriage moves. Movement of stop 88 rightwardly decreases the radius of the arc and the distance of the vanishing point, while leftward movement of stop 88 increases the arc radius and vanishing point distance, thus affording an adjustable selective setting of the arc radius and the vanishing point distance according to the left-right positioning of indicator 92. Left stop 90 stops counterclockwise pivoting of axle 28 and clockwise pivoting of axle 40 to selectively set the arc radius and distance of the left vanishing point according to the left-right positioning of indicator 94.

The carriage and drawing blade supported on the roller means 20 is rollable in one direction to define the noted parallel lines in perspective, and is also rollable in the opposite return direction such that each point along the drawing blade scribes the same respective return arc about the same common point, with the drawing blade defining the same said substantially parallel lines in perspective during return movement radiating substantially from the same said common point as said vanishing point.

Control means 24 selectively enables rolling of the carriage and drawing blade bidirectionally along a right-hand arc about a right vanishing point, and for selectively enabling rolling of the carriage and drawing blade bidirectionally along a left-hand arc about a left vanishing point on the opposite side of the carriage from the right vanishing point. For the right-hand arc, wheels 36 and 46 at the right ends of the axles move towards each other and scribe an inner arc about the right vanishing point, and wheels 38 and 48 at the left ends of the axles move away from each other and scribe an outer arc about the right vanishing point. For the left-hand arc, wheels 38 and 48 move towards each other and scribe an inner arc about a left vanishing point, and wheels 36 and 46 at the right ends of the axles move away from each other and scribe in outer arc about the left vanishing point.

An elongated auxiliary blade (not shown) may be attached to blade 18, as at one or more mounting holes such as 100, to extend the length of the blade and allow the operator to do larger renderings.

It is recognized that various alternatives are possible within the scope of the appended claims.

I claim:

1. A drafting instrument for drawing perspective lines without physically pre-establishing and marking a vanishing point comprising:

a carriage;

a drawing blade on said carriage providing an edge for drawing said lines;

roller means pivotally mounted to said carriage and supporting said carriage for movement along a drawing surface; and control means for adjustably pivoting said roller means such that each point along said drawing blade scribes an arc about a common point as said carriage moves, said drawing blade defining substantially parallel lines in perspective radiating substantially from said common point as a vanishing point as said carriage moves;

wherein said roller means comprises axle means pivotably mounted to said carriage and having wheel means rotatably secured thereto, said axle means and said wheel means having different pivot axes, and wherein said control means comprises means for adjustably setting the degree of pivoting of said axle means to selectively set the radius of said arc and the distance of said vanishing point.

2. The invention according to claim 1 wherein said control means comprises means for moving said blade and scribing an arc selectively about right and left vanishing points comprising first and second stop means for setting clockwise and counterclockwise pivoting of said axle means, and actuator means for selectively pivoting said axle means clockwise and counterclockwise.

3. The invention according to claim 1 wherein said drawing blade is pivotally mounted to said carriage and operatively coupled to said control means to pivot in response to actuation of the latter.

4. The invention according to claim 1 wherein said axle means comprises first and second spaced axles each pivotally mounted to said carriage and operatively coupled to said control means and pivoting in opposite directions in response to actuation of said control means, each axle having wheel means at the distal ends thereof.

5. The invention according to claim 4 wherein said control means is actuatable to pivot said first axle clockwise and said second axle counterclockwise such that said wheel means at right ends of said axles move towards each other and scribe an inner arc about said vanishing point and said wheel means at left ends of said axles move away from each other and scribe an outer arc about said vanishing point.

6. The invention according to claim 2 wherein said axle means comprises first and second spaced axles each pivotally mounted to said carriage and operatively coupled to said control means and pivoting in opposite directions in response to actuation of said control means, each axle having wheel means at the distal ends thereof, and wherein said axles are pivotally mounted to said carriage between their said distal ends, and said control means is actuatable to a first condition pivoting said first axle clockwise and said second axle counterclockwise such that said wheel means at right ends of said axles move towards each other and scribe an inner arc about a right vanishing point and said wheel means at left ends of said axles move away from each other and scribe an outer arc about said right vanishing point, and said control means is actuatable to a second condition pivoting said first axle counterclockwise and said second axle clockwise such that said wheel means at said left ends of said axles move towards each other and scribe an inner arc about a left vanishing point and said wheel means at said right ends of said axles move away from each other and scribe an outer arc about said left vanishing point.

7. A drafting instrument for drawing perspective lines without physically pre-establishing and marking a vanishing point comprising:

a carriage;

a drawing blade on said carriage providing an edge for drawing said lines;

a first axle pivotally mounted on said carriage between the distal ends of said first axle and having wheels rotatably mounted at said distal ends;

a second axle pivotally mounted on said carriage between the distal ends of said second axle and having wheels rotatably mounted at said last mentioned distal ends; and actuator means movably mounted to said carriage and having a first condition oppositely pivoting said first and second axles at their right ends towards each other, and having a second condition oppositely pivoting said first and second axles at their left ends towards each other.

8. The invention according to claim 7 wherein said drawing blade and said actuator means are pivotally mounted to said carriage at the same point.

9. The invention according to claim 7 wherein said first and second axles are pivotally mounted to said carriage at the same point.

10. The invention according to claim 7 wherein said first axle is connected by a first link to transition means which is connected by a second link to said second axle effecting movement of said second axle oppositely to said first axle, said transition means also being connected by a third link to said drawing blade for pivoting the latter in response to movement of said actuator means transmitted through said first link.

11. The invention according to claim 10 wherein said transition means comprises first and second spaced connecting rods each pivotally mounted to said carriage between its distal ends and hinge means operatively coupling said rods, said first rod connected on one side of its pivot to said first link and on the other side of its pivot to said hinge means, said second rod connected on one side of its pivot to said second link and on the other side of its pivot to said hinge means, such that said actuator means in said first condition pivots said first axle clockwise which causes said first link to pivot said first rod clockwise which acts through said hinge means to cause said second rod to pivot counterclockwise which causes said second link to pivot said second axle counterclockwise, said hinge means being connected to said third link to pivot said drawing blade clockwise, and such that said actuator means in said second condition pivots said first axle counterclockwise which causes said first link to pivot said first rod counterclockwise which acts through said hinge means to cause said second rod to pivot clockwise which causes said second link to pivot said second axle clockwise, said hinge means through said connection to said third link causing said drawing blade to pivot counterclockwise.

12. The invention according to claim 11 comprising right and left adjustably movable stops on said carriage, said right stop stopping said clockwise pivoting of said first axle and said counterclockwise pivoting of said second axle to selectively set the arc radius of rolling movement of said wheels along a drawing surface such that each point along said drawing blade scribes a right-hand arc about a common right point as said carriage moves, said drawing blade defining substantially parallel lines in perspective radiating substantially from said common right point as a right vanishing point, movement of said first stop selectively setting the radius of said right-hand arc and the distance of said right vanishing point, said left stop stopping said counterclockwise pivoting of said first axle and said clockwise pivoting of said second axle to selectively set the arc radius of rolling movement of said wheels along a drawing surface such that each point along said drawing blade scribes a left-hand arc about a common left point as said carriage moves, said drawing blade defining substantially parallel lines in perspective radiating substantially from said common left point as a left vanishing point, movement of said second stop selectively setting the radius of said left-hand arc and the distance of said left vanishing point.

* * * * *